US005511347A

United States Patent [19]

Schwarz

[11] Patent Number: 5,511,347

[45] Date of Patent: Apr. 30, 1996

[54] ADJUSTABLE SHEET METAL MOULDS FOR STEEL AND PRECAST CONCRETE STAIRS

[76] Inventor: Horst G. W. Schwarz, 7089 President Drive, Niagara Falls, Ontario, Canada, L2J 3T8

[21] Appl. No.: 335,166

[22] Filed: Nov. 7, 1994

[51] Int. Cl.[6] ..... E04F 11/00

[52] U.S. Cl. ..... 52/182; 52/189; 52/190

[58] Field of Search ..... 52/182, 189, 190

[56] References Cited

U.S. PATENT DOCUMENTS

| | | | |
|---|---|---|---|
| 894,801 | 7/1908 | Schachner | 52/190 X |
| 1,457,515 | 1/1923 | Frisch | 52/190 X |
| 1,497,058 | 1/1924 | Barriball | 52/190 |
| 2,155,908 | 4/1939 | Samonds | 52/190 X |
| 3,405,486 | 10/1968 | Fagenstrom | 52/190 |
| 3,466,820 | 9/1969 | Sender | 52/190 X |
| 3,672,106 | 6/1972 | Mulitz | 52/189 X |
| 3,875,708 | 4/1975 | Thorsnes | 52/189 |
| 4,838,005 | 6/1989 | Graham et al. | 52/189 X |
| 4,899,504 | 2/1990 | Hirschhurn | 52/182 |
| 5,014,475 | 5/1991 | Anderson, Jr et al. | 52/189 X |

FOREIGN PATENT DOCUMENTS

| | | | |
|---|---|---|---|
| 0235945 | 10/1961 | Australia | 52/190 |

*Primary Examiner*—Wynn E. Wood
*Attorney, Agent, or Firm*—Wallace F. Neyerlin

[57] ABSTRACT

Sheet steel pan forms bent or rollformed to specific "universal" profiles allow the manufacture of concrete tread filled steel stairs or precast concrete stairs. The profiles adjust against each other under the specific angle of 26.565 and thereby, used in series, create stairways of various rise and run relations, maintaing the same profile at all times, satisfying requirements of all building codes and follow the measure of the human step on an incline.

These "universal" profiles are designed to standardize stair construction, save labor and material and produce stairs more economically than conventional methods employed in today's construction industry.

16 Claims, 10 Drawing Sheets

ADJUSTABLE SHEET METAL MOULDS FOR STEEL AND PRECAST CONCRETE STAIRS

BACKGROUND OF THE INVENTION

This invention relates to metal pan steel and precast concrete stair construction; in particular to adjustable metal pan profiles for production of stairs which ideally suit the human step length on an incline and also comply with building code requirements. Instead of manufacturing custom dimensioned sheet metal pan forms for each specific riser and run condition, this invention makes it possible to cover all riser and run relations that occur in buildings. This is achieved by sliding individual pan profiles against each other as described in the summary of the invention and detailed description hereinafter.

SUMMARY OF THE INVENTION

Sheet metal steel pan profiles are slid against and coupled to each other to any desired riser and run relation in millimetric increments under the specific angle of 26.565 degrees to the horizontal. Each and every riser and run relation will result in the formulated summation of the human step length on an incline, namely two risers plus one run equals 24¾ inches. Building code requirements are thus met. Steel stair sheet metal profiles are self adjusting as the mounting of the angle support bracket used with same is welded to the stringer with one and only adjustable template for layout. This makes steel stair assembly fast and easy, thereby saving labour costs.

The shape of the metal pan profile adds structural strength to the tread and riser pan and can be formed out of thinner gauge material. This represents a potential 20% material saving over conventional tread and riser profiles. Further economical advantages can be realized by roll-forming the profile (mass production). Since the support angle never changes length or shape it can be mass produced and stocked for sale to the steel stair manufacturer.

The sheet metal pan form for precast concrete is also adjustable by means of sliding profiles of same against each other under the specific angle mentioned above and achieve the same riser and run related results. The individual profiles are linked together with clamping devices as detailed in drawings which follow. The external clamps are equipped with turnbuckle couplings welded to the metal pan form and the clamping device respectively. Profiles are adjusted manually in millimetric increments to the desired position. Profiles can readily be attached or detached to produce any length of precast concrete stair. Due to a mobile insert of formed plywood shapes attached to each other by a tongue and groove joint, it is possible to use, for instance, a six feet wide form to produce any width stair up to 6'–0".

Both steel stair metal pan forms and steel pan metal forms for precast concrete stairs are simple and easily assembled. They have multiple advantages over today's still conventional methods of stair construction, namely:

Universality (controlled rise and run relation as desired in accordance with a scale such as hereinafter set forth);

Ease of assembly (labour and cost effective—cost savings of 15–20%);

Efficiently meeting code requirements; and

Pleasing architectural appearance.

The two profiles may be hereinafter referred to as the: U.T.R.P. (The Universal Tread and Riser Pan) sheet metal steel profile; and U.T.R.P.F. (The Universal Tread and Riser Pan Form) sheet metal steel pan form for precast concrete.

The U.T.R.P. pan form may be referred to as having a geometric cross-sectional shape with one portion A similar to a dipper or ladle and a second portion B which may be referred to as the handle portion. This pan form has seven sides as described and referred to in more detail hereinafter.

The U.T.R.P.F. pan form may be referred to as having a geometric cross-section similar to an inverted "S". This pan form has five sides as described and referred to in more detail hereinafter.

Note is made here that the sliding angle of 26.565 degrees is such as to achieve the ideal rise and run relation of two risers plus one run equaling 24¾" as is apparent from a review of the following schedule; but that slight plus or minus variations from this angle may be possible and still be within the purview of the teachings of this invention; and/or might be possible or necessary should code requirements change for some unknown reason.

Range Schedule of Rise and Run Relation for U.T.R.P. and U.T.R.P.F. Adjustable Profiles in Inches

| | | | | | | | | | | | | | |
|---|---|---|---|---|---|---|---|---|---|---|---|---|---|
| RISE | 6⅜ | 6½ | 6⅝ | 6¾ | 6⅞ | 7 | 7⅛ | 7¼ | 7⅜ | 7½ | 7⅝ | 7¾ | 7⅞ |
| RUN | 12 | 11¾ | 11½ | 11¼ | 11 | 10¾ | 10½ | 10¼ | 10 | 9¾ | 9½ | 9¼ | 9 |

NOTE: Rise and run can adjust to the smallest decimal increments by interplation. Two risers plus one run equals 24 ¾" always. Total vertical adjustment is 1½ inches. Total horizontal adjustment is 3 inches.

It should be noted that the U.T.R.P. and U.T.R.P.F. never change shape or form dimensionally to achieve the above. Treaqd depths always to be 12 inches, which allows for standard size finish application of quarry or vinyl tile if so desired. There are numerous anti-slip strip devices manufactured in aluminum available in the industry which can be poured into the concrete tread edges to meet specification requirements.

The invention and its teachings will become clearer after reviewing the drawings and the following specification describing same.

It should be noted that such precast concrete stairways will typically be reinforced with steel bars and molded to whatever stairway widths and heights or lengths are desired, and away from the sites where they are intended to be used; whereas the stairways made by using the U.T.R.P. are fabricated on-site where they are to be used and not typically reinforced with steel bars.

Figures 12, 13, 14:
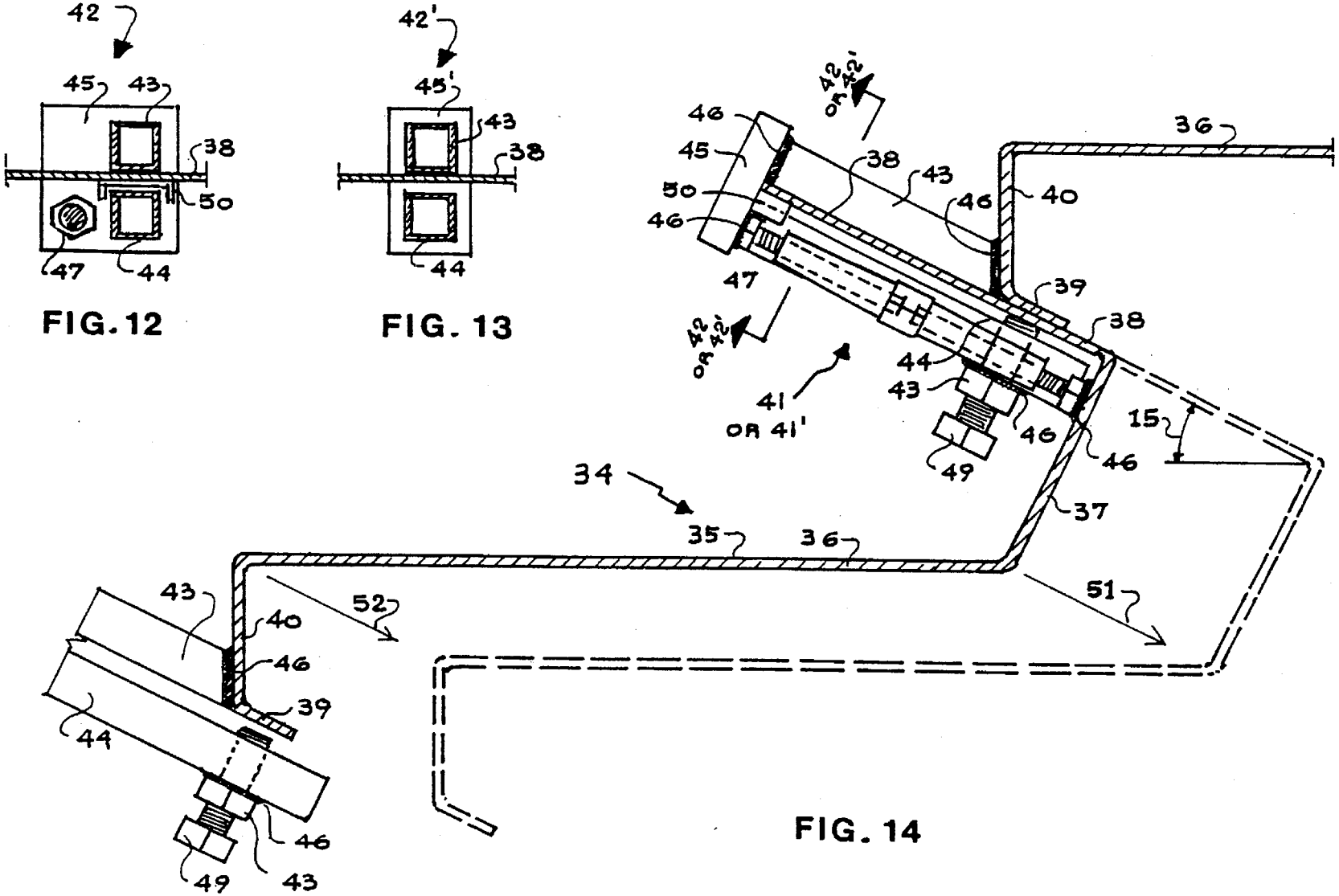

FIG. 12 is a section taken across the external end of the clamping means used in FIG. 14 to adjust the pitch in order to "custom build" a stairway, and FIG. 13 is a section taken across an intermediate portion of the clamping means used in FIG. 14 to adjust the pitch.

FIG. 14 is a cross-sectional view of the adjustable U.T.R.P.F. profile of the invention illustrating the means for adjusting the pitch of the profile, the solid lines illustrating minimum pitch, i.e., minimum rise and maximum run; and the broken lines illustrating how alteration is possible to change the profile to maximum pitch, i.e., maximum rise and minimum run.

Figure 15:
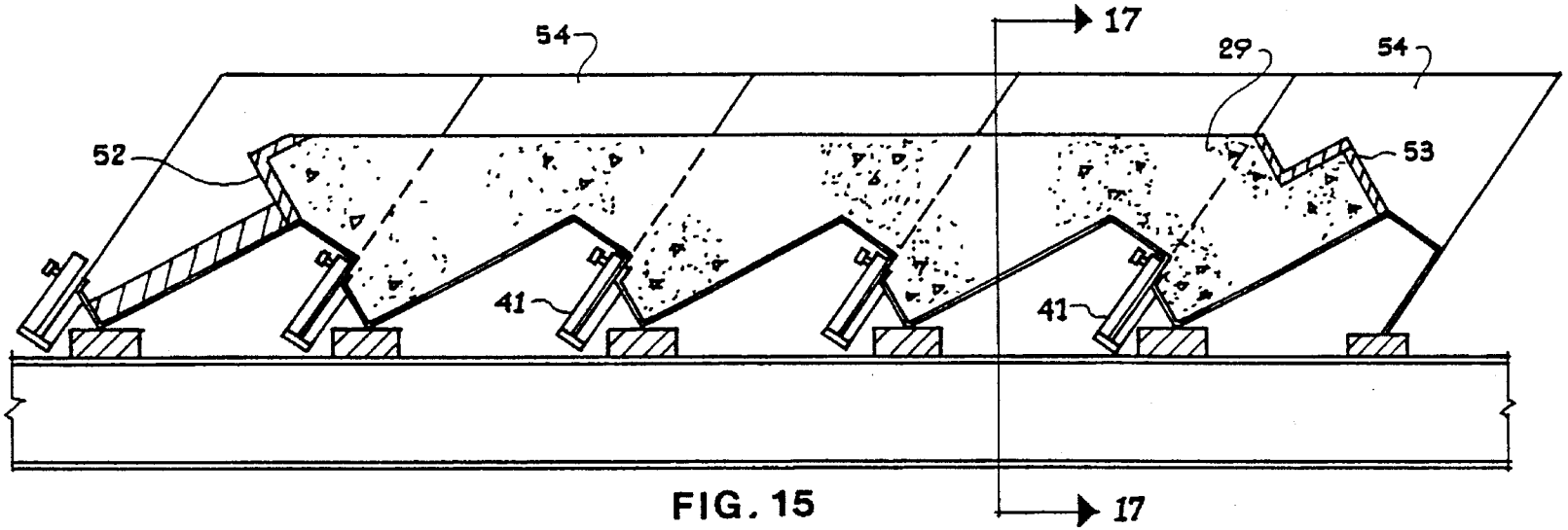
Figure 16:
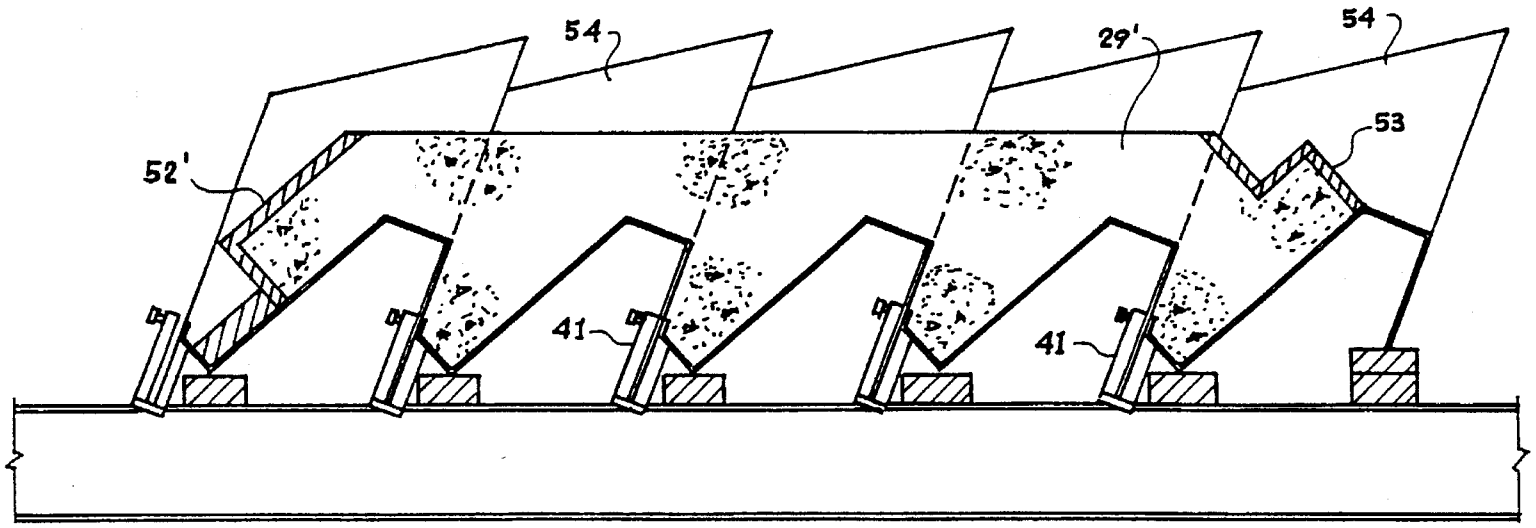

FIGS. 15 and 16 are cross-sectional views through U.T.R.P.F. assemblies with concrete in place, (reinforcing steel bars not shown); FIG. 15 illustrating an assembly for producing stairs with minimum pitch and FIG. 16 illustrating an assembly for producing stairs with maximum pitch.

Figure 17:
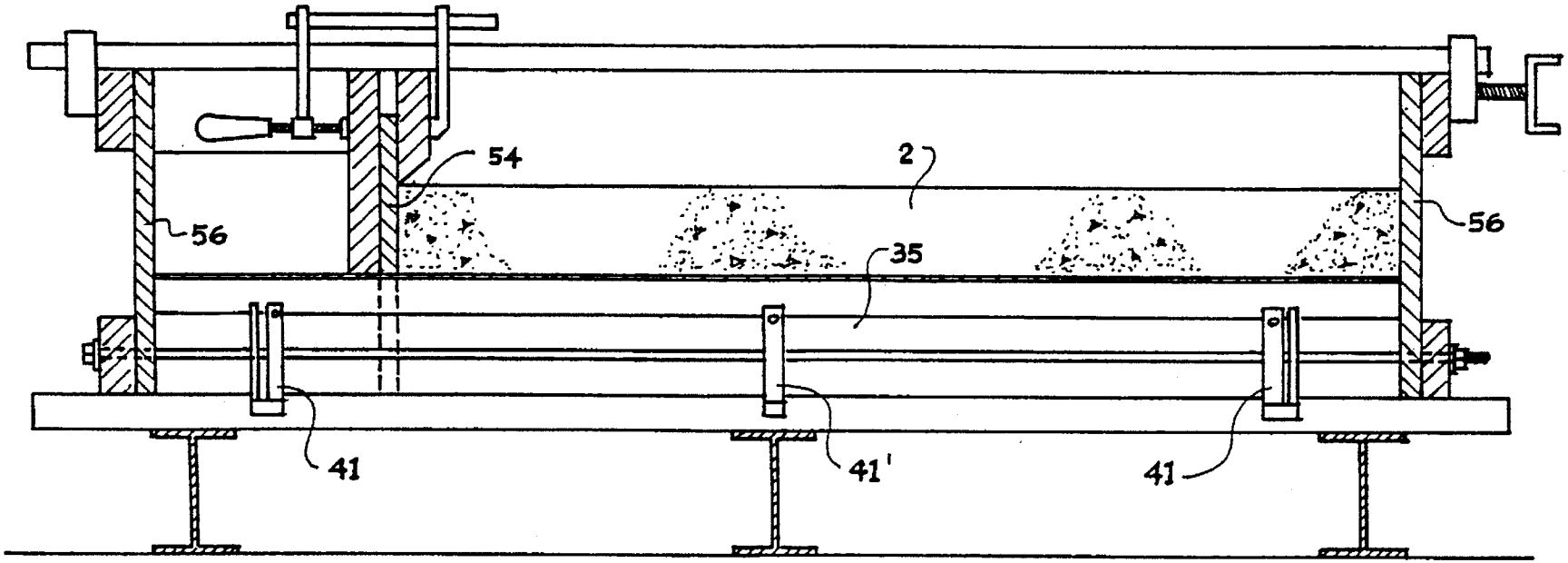

FIG. 17 is a section of the U.T.R.P.F. assembly of FIG. 15 with concrete in place taken across line 17—17 of FIG. 15. This figure also illustrates adjustable bulkheads utilized at the sides of the pan forms to retain the concrete poured into the assembled pan forms to build the precast stairways.

DETAILED DESCRIPTION OF THE DRAWINGS AND OF THE PREFERRED EMBODIMENTS OF THE INVENTION

Figure 1:
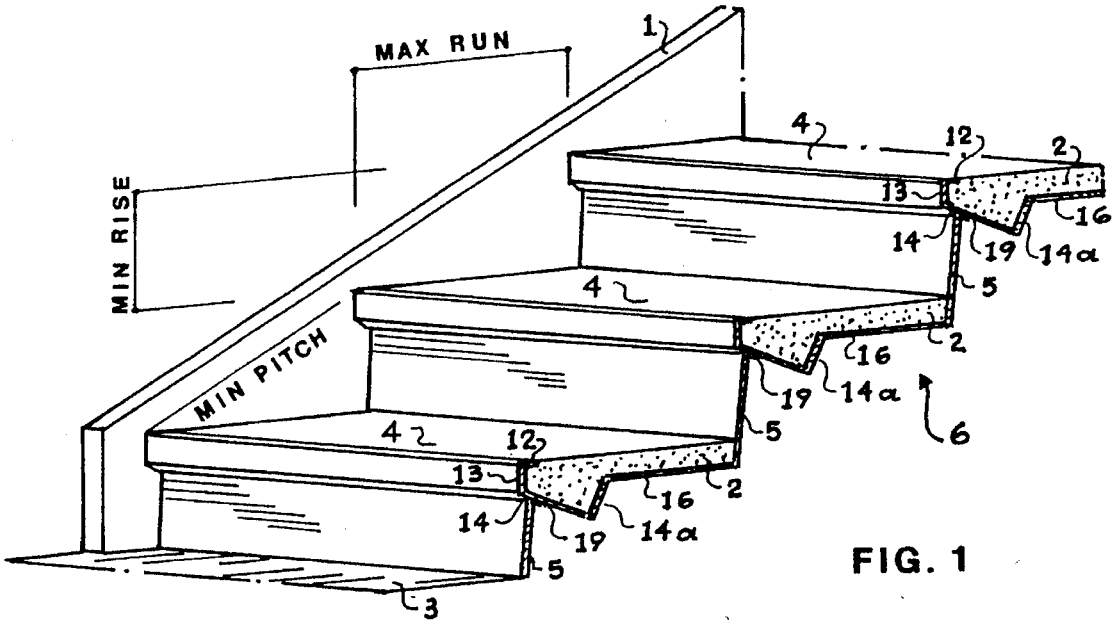
FIG. 1 is an isometric sectional view of a concrete filled steel stairway using the U.T.R.P. showing a minimum pitch, i.e., minimum rise and maximum run.
Figure 2:
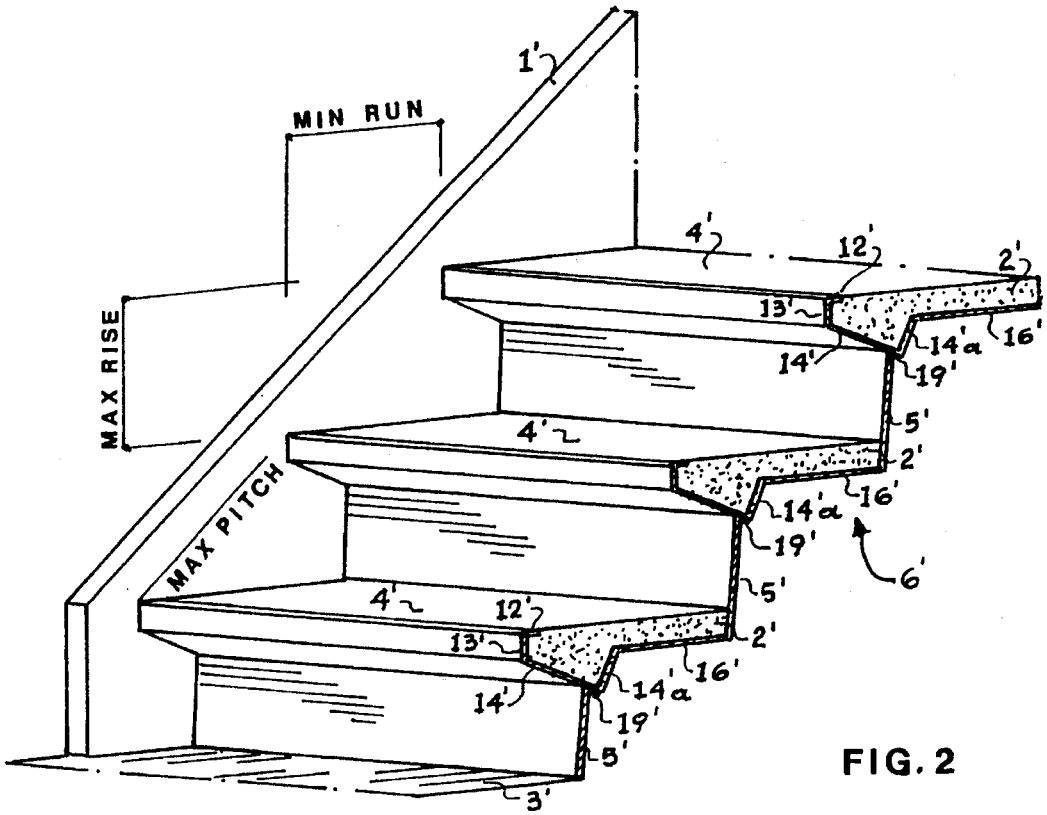
FIG. 2 is an isometric sectional view of a concrete filled stairway illustrating maximum pitch, i.e., maximum rise and minimum run dimensions.

FIGS. 1 and 2 illustrate U.T.R.P. profiles 6 and 6' (which numerals depict or refer to the entire profile), attached to each other in adjusted position by one inch long fillet welds 19 at 12" O.C. (on center). The profiles are also attached to 12" channel stringers 1 on each side of the stairway. (Stringer which would be on the right side of stairway is not shown). Riser 5 and nosing 12 and 13 are part of the pan form 6, the nosing part to be used at the upper floor or landing as illustrated. Riser 5 also stands on floor surface 3. These U.T.R.P. profiles show job site concrete fill 2 which forms the tread and walking surface 4. FIG. 1 shows a U.T.R.P. assembly of pan forms adjusted to maximum run and minimum rise resulting in minimum pitch.

FIG. 2 shows a U.T.R.P. assembly of pan forms adjusted to minimum run and maximum rise resulting in maximum pitch. The numbers of FIG. 2 refer to the same elements as in FIG. 1, but are primed simply to indicate that the stairway constructions are different.

Figure 3:
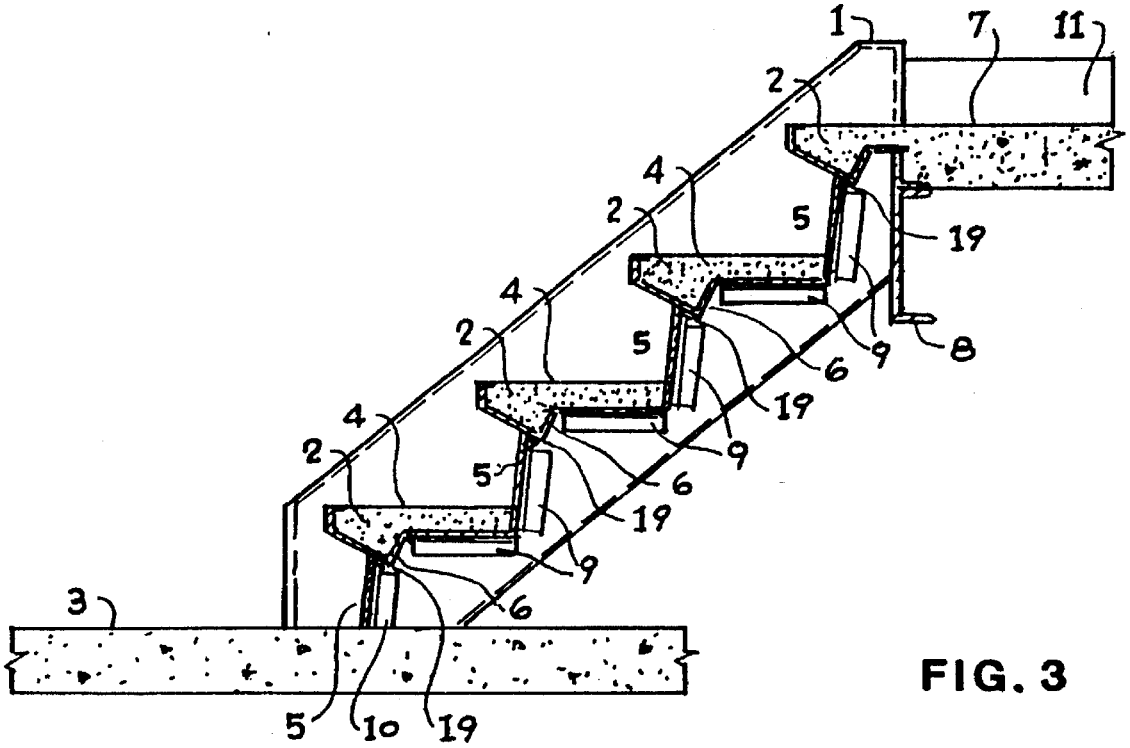
FIGS. 3 and 4 are cross-sectional views of a filled steel stairway illustrating maximum pitch, i.e., minimum run and maximum rise (FIG. 3); and minimum pitch, i.e., maximum run and minimum rise (FIG. 4).
Figure 4:
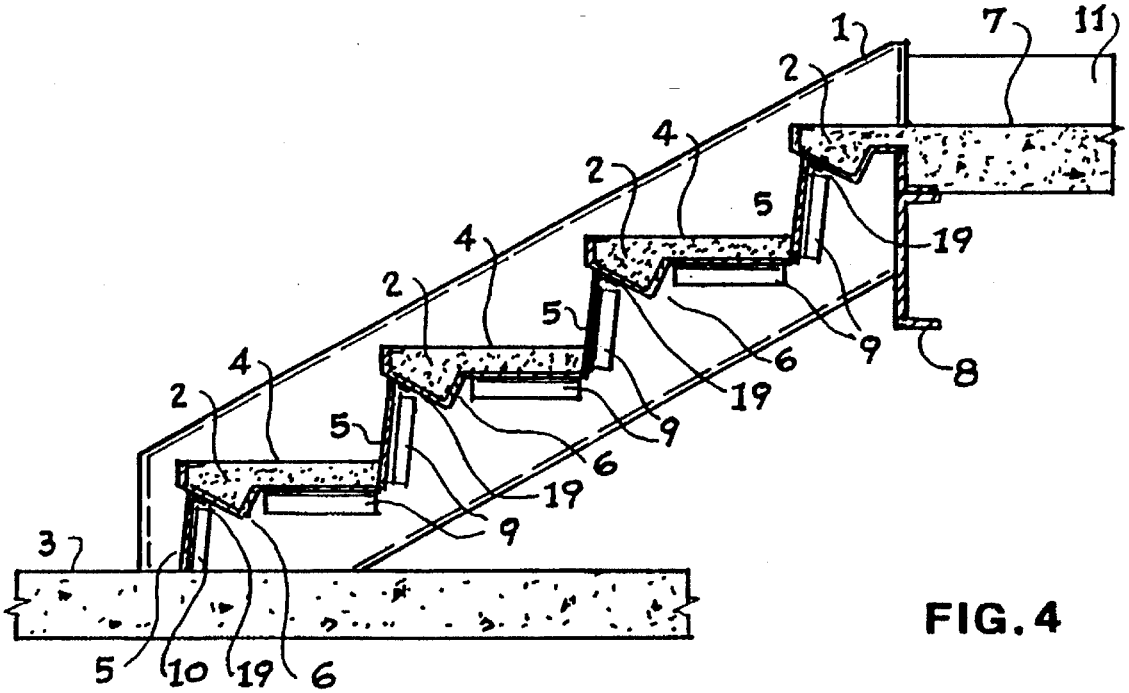

FIGS. 3 and 4 are sections through concrete filled U.T.R.P. assemblies showing U.T.R.P. profiles 6 attached to each other by welds 19. The profiles are attached to the 12" channel stringers 1 by means of bent tread and riser support angles (1¼"×1¼"×⅛") 9. The support angles are welded to stringer 1 and profiles 6. Tread portion of U.T.R.P. shows concrete filled 2 which forms the walking surface 4. The first riser 5 (at the bottom of the stairs) is attached to stringer 1 by means of support angle 10 which is welded to stringer and riser. Numeral 7 represents landing surface and numeral 11 the base at the landing level. The stair and landing are supported by steel channel 8.

FIG. 3 shows adjusted profiles to maximum rise and minimum run (maximum pitch); and FIG. 4 shows adjusted profiles to minimum rise and maximum run (minimum pitch).

Figure 5:
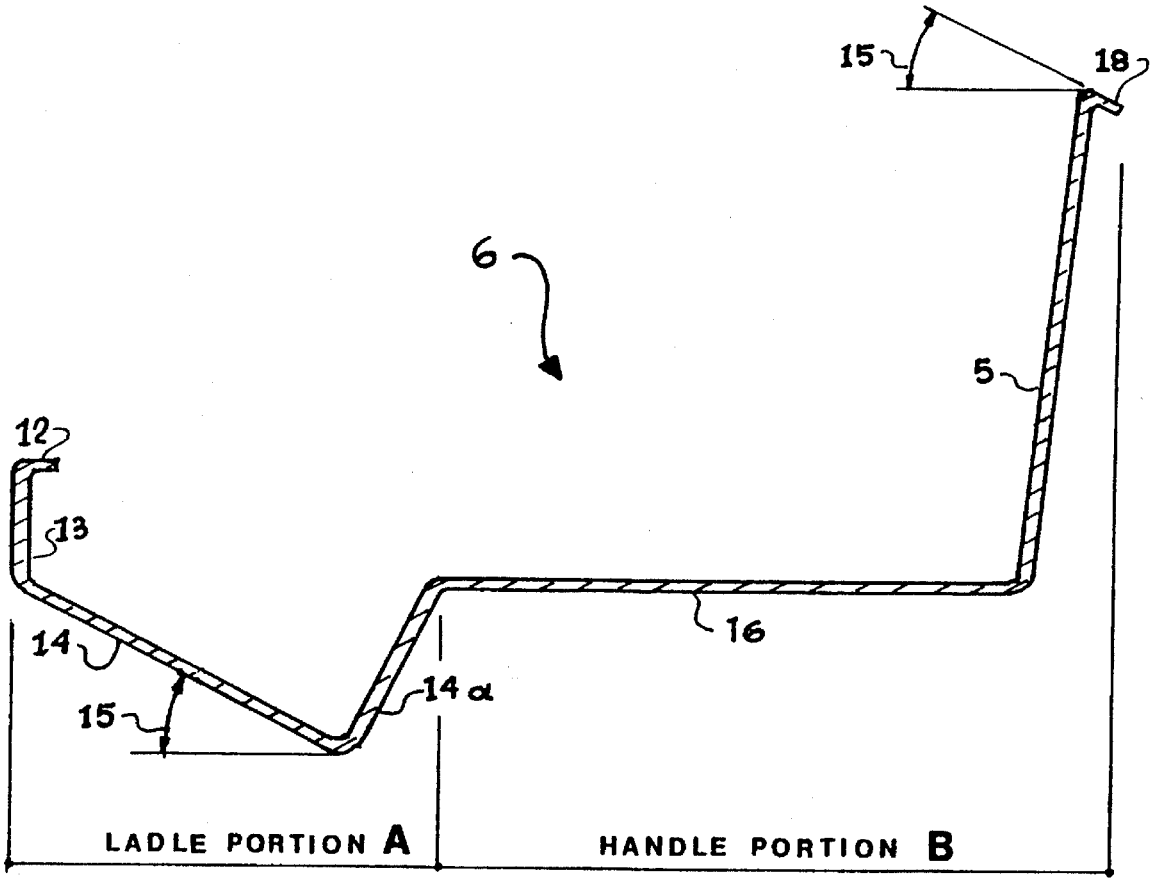
FIG. 5 is a section taken across the sheet metal steel pan profile, i.e., U.T.R.P.

FIG. 5 is an enlarged sectional view of the U.T.R.P. pan form 6 and depicts the unique shape of this pan form. Numeral 6 depicts the pan form in general; the numeral 5 refers to the portion of the pan form used for shaping the risers of the stairs; numeral 16 refers to the portion of the pan form used for shaping the tread of the stairs; numeral 13 refers to the nosing face end of the pan form; numerals 14 and **14*a* refer to the sloped portions of the nose and tread utilized to contain and retain the material employed in the pan form (such as concrete) in the making of the treads of the stairs; numeral 12 refers to a return portion of the nose end of the pan form; and numeral 18 refers to the return portion of the riser portion of the pan form, which portion 18 is also for attachment by welding to portion 14** of each successive pan form of the stairs of the stairway as shown in several of the Figures.

It is important to note with reference to this Figure that the pan form has seven sides with one portion "A" similar to a dipper or ladle made up of sides 12, 13, 14, and **14*a*; and another portion "B" referred to as a "handle" portion made up of sides 16, 5 and 18; that leg 14 of the pan is at an angle 15 of 26.565 degrees to horizontal (or to normal) as previously stated; (as is return portion 18); and that the angle between 14 and 14*a* is 90 degrees. These relationships are important in order to efficiently accomplish the goals of the invention. Also, the angle between elements 16 and 5** is 96 degrees.

Typical dimensions (in inches) of the elements of the steel pan form, which is preferably made from 14 or 12 gauge sheet metal steel (i.e., about ⅛ inch thick, depending on stair width) are as follows:

| Element | Length | Sides of Pan Form as Referred to In the Claims |
|---|---|---|
| 5 | 6 1/32" | f |
| 13 | 1½" | b |
| 12 | ½" | a |
| 16 | 7" | e |
| 14 | 4.472" | c |
| 14a | 2.236" | d |
| 18 | ½" | g |

Figure 6:
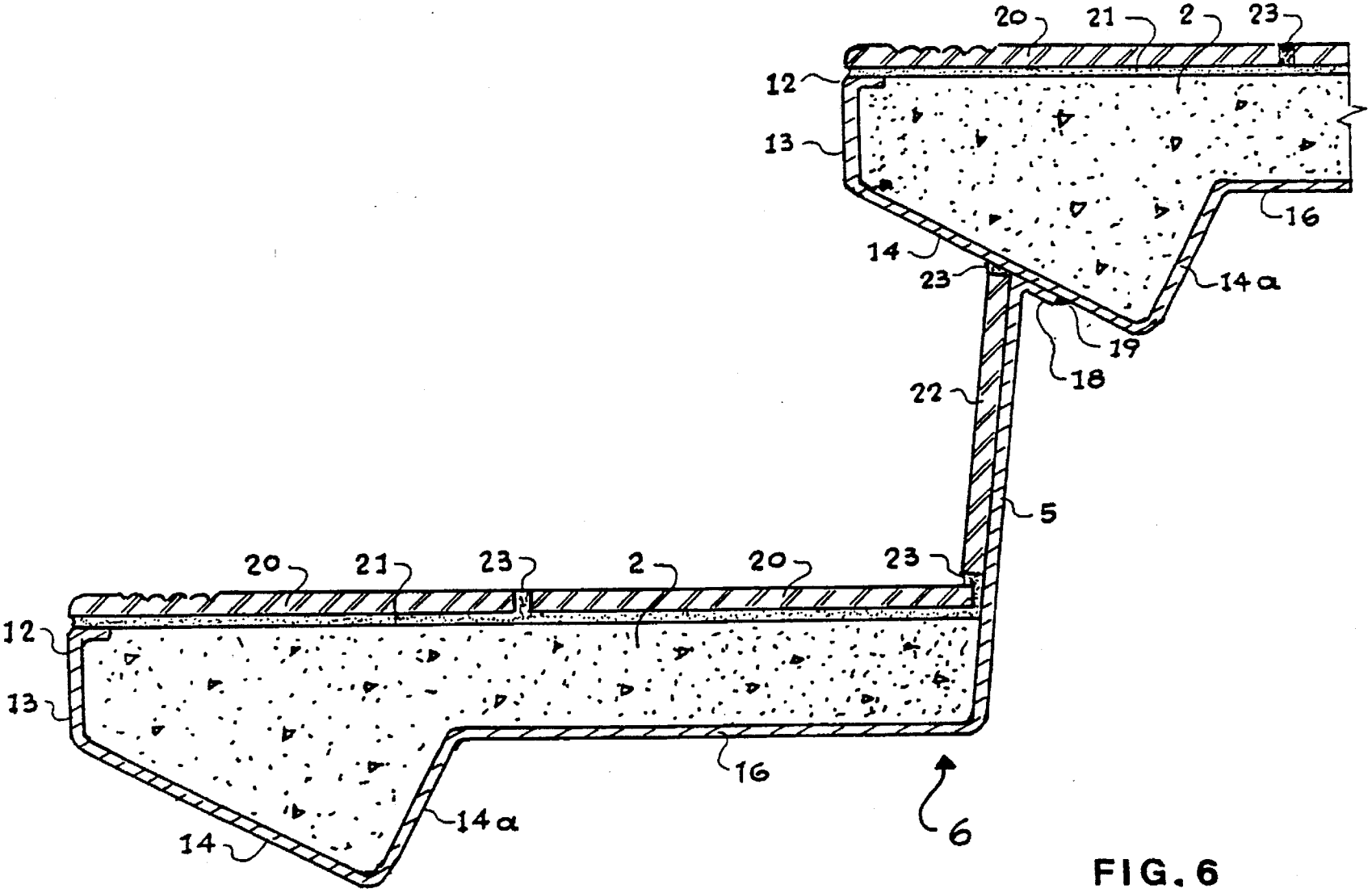
FIG. 6 is a section taken through the U.T.R.P. sheet metal steel pan of FIG. 5 wherein the steel pan is filled, such as with concrete, and also covered with quarry tile, covering tread and riser, and also showing a complete steel pan coupled to another steel pan (shown only partially).

Referring now to FIG. 6, numeral 2 refers to concrete; numerals 12, 13, 14, **14*a*, 16, 5, and 18 refer to elements of the pan form previously discussed; numeral 19 refers to a one inch long fillet welding used to sturdily connect one pan form 6 to another pan form; numeral 22 refers to a riser tile and numeral 20 refers to a tread tile. The tread pans are filled with concrete 2. Tread tiles 20 are attached to the concrete filled pan with a cement 21, typically an epoxy thin set cement. The tile joints are typically filled with a tile grout 25. The riser tile 22, which is optional, will also typically be epoxy glued to riser part 5** of the pan form.

It is to be noted that the various pan forms 6, which are joined to each other, thus become an integral part of and provide strength to the various stairways to be built in the manner described.

Figure 7:
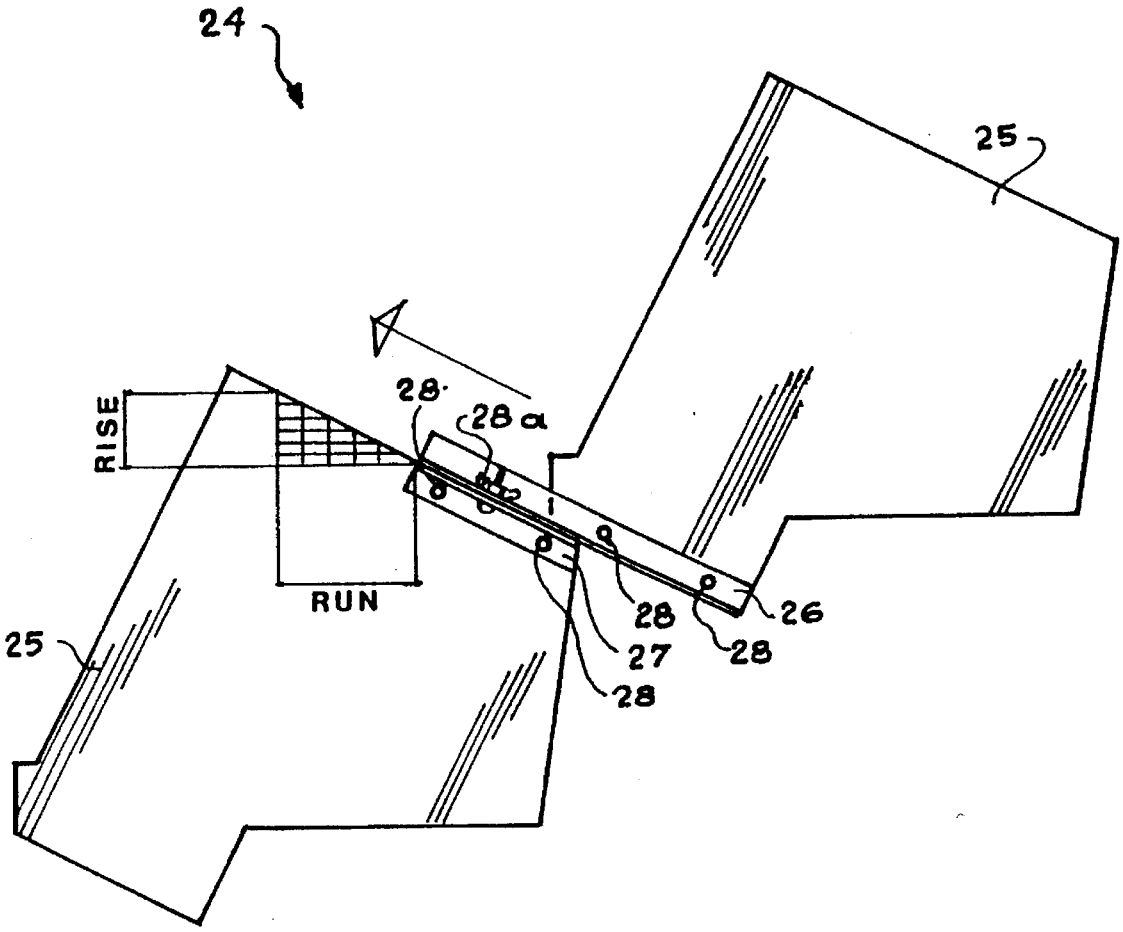
FIG. 7 is a plan view of the adjustable layout template for laying out the U.T.H.P. profile on a stair stringer, said layout also illustrating how the template may vary the rise anywhere from 6⅜ inches to the 7⅞ inches previously described.

FIG. 7 shows a plan view of an adjustable layout template 24 for providing U.T.R.P. profile layout on a steel stringer. One-half inch thick (typical) plywood pieces 25 are cut to match U.T.R.P. profiles as illustrated.. Aluminum angle 26 is slotted lengthwise to allow for sliding adjustment at wing nut and bolt 28A. Aluminum angle 27 is attached to the opposite plywood piece via wood screws 28. Angle 27 has a hole in it to fit wing nut and bolt 28A. Bottom plywood piece 25 also has a rough graph drawn on same to illustrate how the template layout arrangement can be easily varied so as to provide a run varying from a maximum of 12 inches to a minimum of 9 inches and a rise varying from a minimum of 6⅜ inches to a maximum of 7⅞ inches as previously described. Such a template is used to layout nosing and support angle positions on steel stringer for all U.T.R.P. steel stairs.

FIGS. 8, 9, 10, and 11 all relate to precast concrete stairs made by using the U.T.R.P.F. embodiment of this invention, i.e. stairways built by using the U.T.R.P.F. pan form of the invention, but which do not retain the pan form as part of the stairway after the concrete has set.

Figure 8:
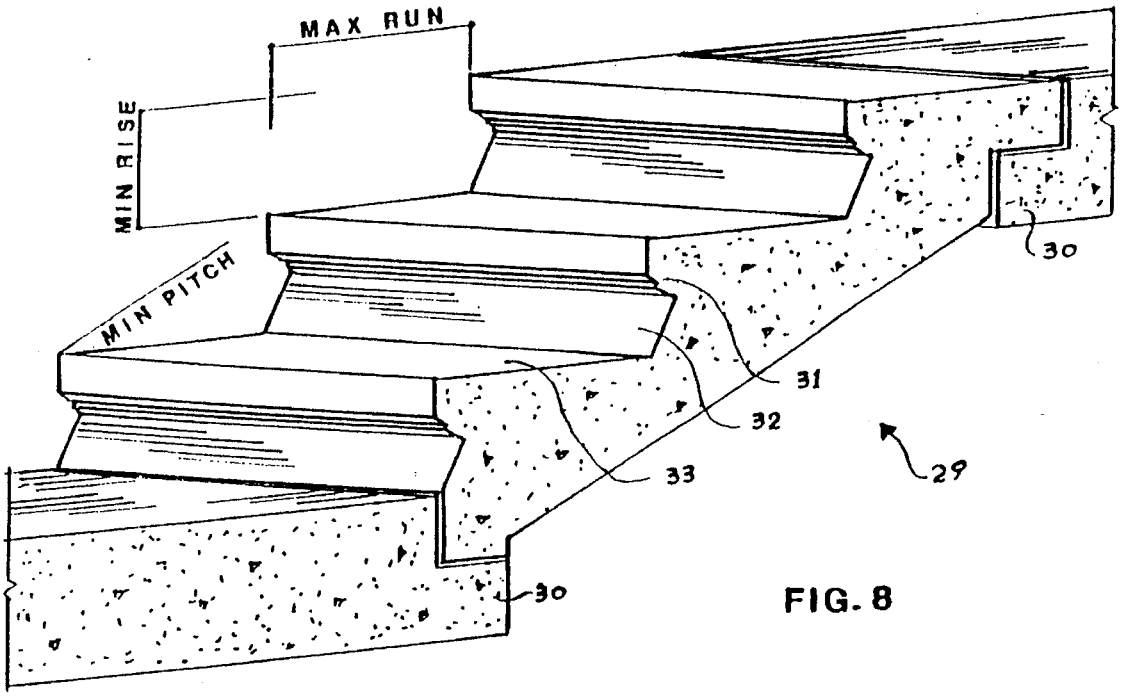
FIGS. 8 and 9 are isometric sectional views of precast concrete stairs showing minimum rise and run possibilities using the adjustable U.T.R.P.F., i.e., the Universal Tread and Riser Pan Form of this invention.
Figure 9:
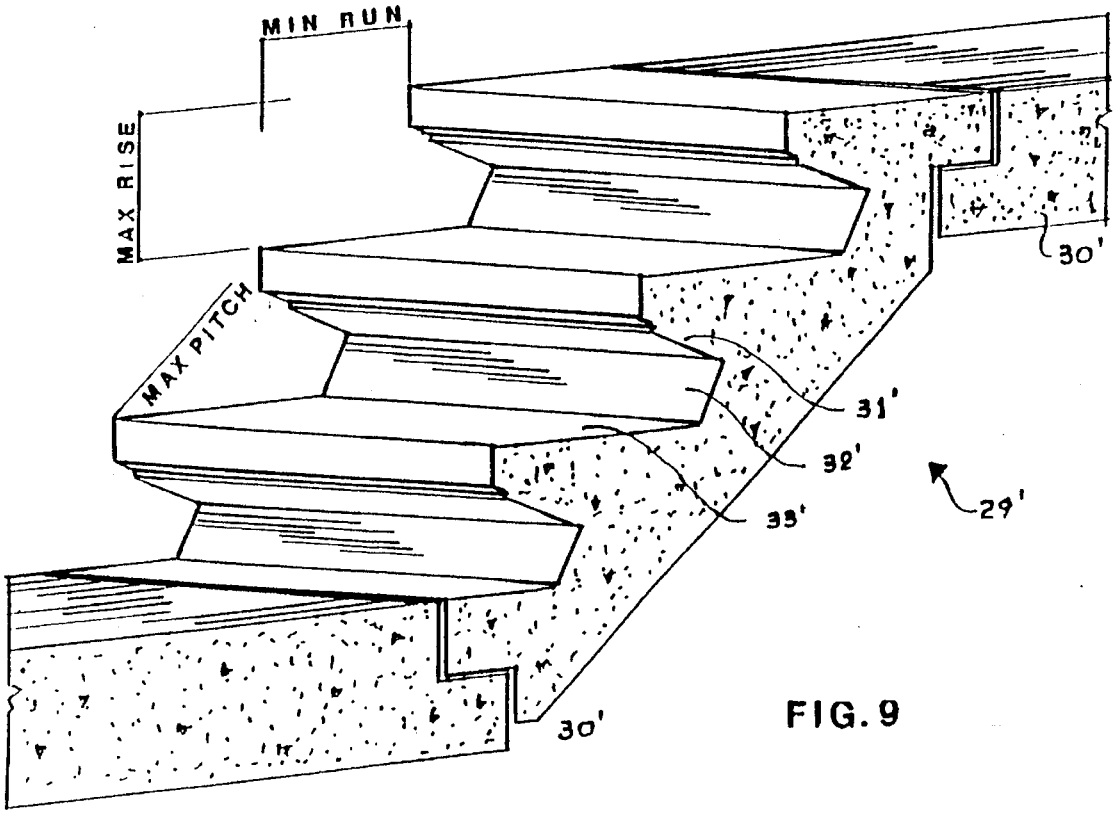
Figure 10:
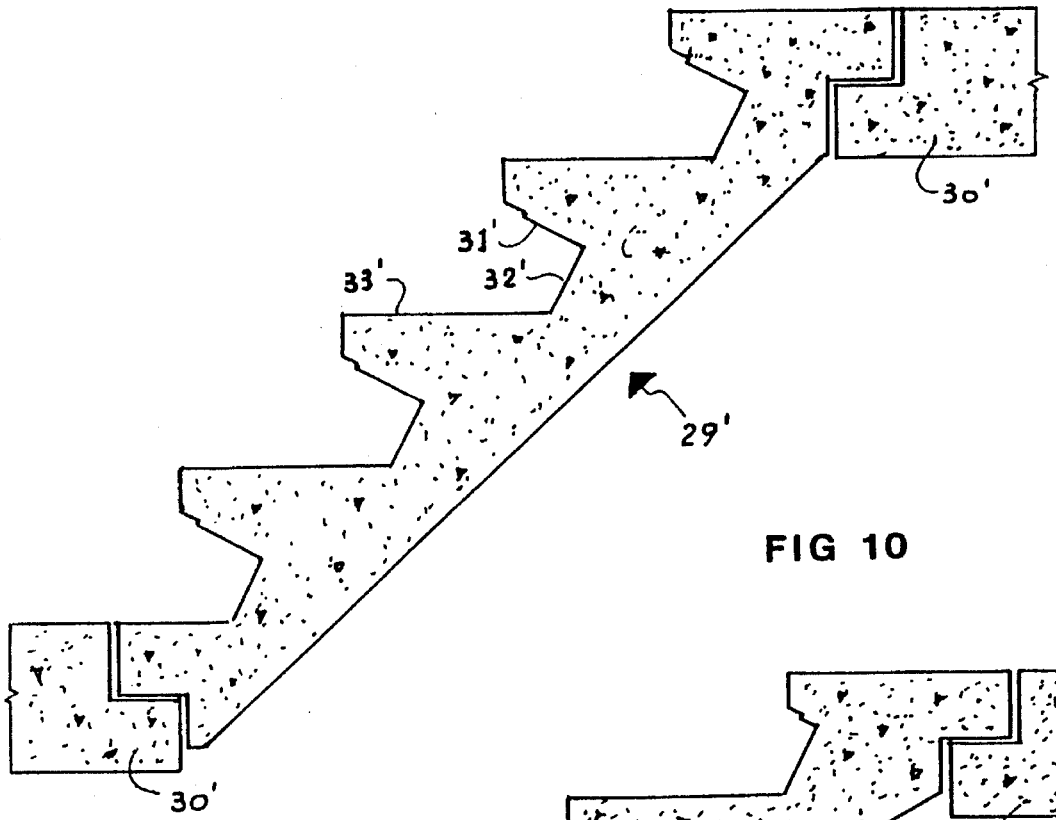
FIG. 10 is a cross-sectional view through a precast concrete stairway as cast using the universal tread and riser steel pan adjustable form illustrating maximum pitch, i.e., maximum rise and minimum run.
Figure 11:
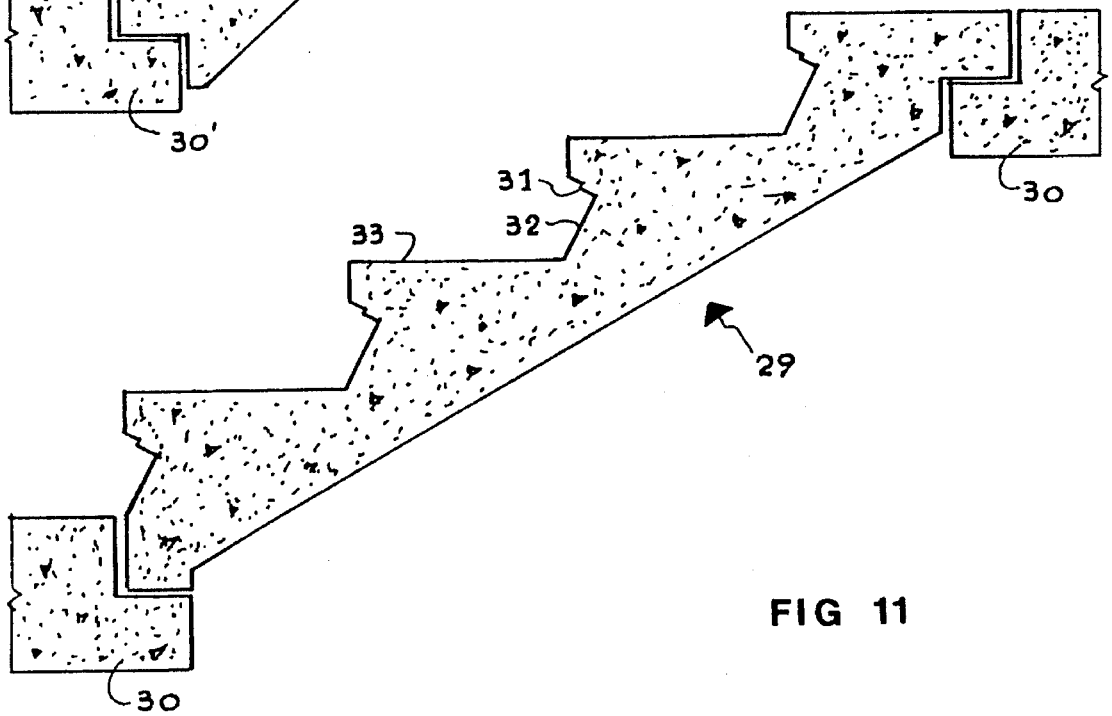
FIG. 11 corresponds with FIG. 10 except it is included in order to illustrate a minimum pitch stairway built with the adjustable form of this invention, i.e., minimum rise and maximum run.

FIGS. 8 and 9 are isometric sectional views and FIGS. 10 and 11 are cross-sectional views; FIGS. 8 and 11 illustrating stairways with minimum pitch and FIGS. 9 and 10 illustrating stairways with maximum pitch; FIG. 11 being a cross-section of the stairway of FIG. 8, and FIG. 10 being a cross-section of the stairway of FIG. 9.

In FIGS. 8 and 11, numeral 29 refers to precast concrete stairs in general; numeral 30 refers to precast concrete landings, which landings have bearing ledges for the stairs; numeral 31 refers to the nosing of the stairs; numeral 32 refers to the riser portion; and numeral 33 refers to the tread portion. These same numbers are used in FIGS. 9 and 10 for the corresponding elements, but are "primed" to denote the alternative embodiments. Nosing part 31 (or 31') slopes under the specific angle of 26.565 degrees to the horizontal in all four of these Figures.

FIG. 14 shows a detailed section through an assembly, depicted in general by numeral 34, of U.T.R.P.F. profiles (one profile shown fully and a second partially shown to illustrate how any number of such profiles would be attached to each other). They are attached to each other via a clamping device assembly referred to in general by numeral 41 or 41'.

Form pan 34 is herein referred to as having a geometric cross-section similar to an inverted "S" and has five sides as shown: nosing return side 39; a nosing face 40; a tread part part 37; and a nosing part 38.

Typical dimensions, in inches, of the elements of the U.T.R.P.F. steel pan form, which is preferably also made from 14 or 12 gauge sheet metal steel, are as follows:

| Element | Length | Sides of U.T.R.P.F. Pan Form As Referred to in the Claims |
|---|---|---|
| 39 | 1 | J |
| 40 | 2⅜ | K |
| 36 | 12 | L |
| 37 | 3⅝ | M |
| 38 | 5.5–6.0 | N |

Element 39 is at an angle of 26.565 degrees to horizontal; element 40 is at an angle of 90 plus 26.565 degrees to element 39; element 36 is at a right angle of 90 degrees to element 40; element 37 is at an angle of 116.565 degrees to element 36; and element 38 is at an angle of 90 degrees to element 37.

The clamping device and adjusting device 41 or 41' of FIGS. 12, 13 and 14, is comprised of short structural tubing 43 joined to nosing face 40 and end plate 45 by welds 46. Long structural tubing 44 is welded to end plate 45 only. Turnbuckle assembly 47 consists of two oppositely threaded bolts in the turnbuckle body. Heads of turnbuckle bolts are joined to end plate 45 and riser part 37 by welds 46. For clamping, set bolt 49 is used. Nut 48 of the set bolt is welded to tubing 44, which is provided with a hole for set bolt 49 to pass through. Guide channel 50 is welded to nosing part 38.

The solid lines in FIG. 14 illustrate an assembly arrangement for minimum rise and maximum run; and the broken lines illustrate how an adjustment 51 is possible to change it to a maximum rise and minimum run.

FIG. 12 is an intermediate cross-sectional view of clamping device 45 taken across line 42—42 of the clamping and adjusting device of FIG. 14. Nosing part 38 slides between tubing 43 and 44 with channel guide 50 being attached to 38. Numeral 47 is a cross-section of the turnbuckle and numeral 45 refers to the end plate.

FIG. 13 is similar to FIG. 12 except that it is a section taken across a smaller end plate 45' and refers to an alternate intermediate size clamping device.

FIGS. 12, 13, and 14, relating to the clamping device assembly, all help to teach how making changes in the pitch of the precast stairways to be built can be accomplished as "built to custom" by using the U.T.R.P.F. pan forms of the present invention.

FIGS. 15 and 16 show U.T.R.P.F. pan form assemblies 41 in position for forming precast concrete stairways 29 or 29' with concrete poured into the assemblies. (As previously stated, such concrete would generally be reinforced, such as with steel bars). The bottom ends of the assemblies possess wooden forms 52 or 52' and the top ends possess wooden forms 53 or 53'. Intermediate widths of stairways to be built can be constructed using adjustable form plywood profiles 54. The profiles are joined to each other with tongue and groove. FIG. 15 shows maximum run and minimum rise (minimum pitch) adjustment; and FIG. 16 shows minimum run and maximum rise (maximum pitch) adjustment.

FIG. 17 is a section of assembled U.T.R.P.F. forms taken across line 17—17 of FIG. 15. Numeral 56 depicts plywood side forms attached to the U.T.R.P.F. ends via bolt rods on bottom and pipe clamps at top as illustrated. The adjustable width bulkhead 54 is blocked with wood spacers against side form 56. Numeral 41 depicts the clamping device assembly in general.

It will be appreciated that the foregoing specification and the accompanying drawings are set forth by way of illustration and not limitation, and that various modifications and changes may be made therein without departing from the spirit and scope of the present invention, which is to be limited solely by the scope of the appended claims.

I claim:

1. A universal tread and riser pan form useful for building a step of a stairway, said pan form having a geometric cross-sectional shape with one portion A similar to a dipper or ladle and a second portion B which is referred to as the handle portion; said ladle portion A having four sides, said sides including a first side having a length and being horizontal, said first side having a first end connected to a first end of a second side at an approximate angle of 90 degrees, said second side being approximately three times the length of said first side, said second side having a second end connected to a first end of a third side at an angle of 116.565 degrees, said third side being approximately three times the length of said second side and a fourth side having a first end connected to a second end of the third side at an angle of approximately 90 degrees, said fourth side having about half the length of said third side; said handle portion B having three sides, said sides including a first side having a first end connected to a second end of the fourth side of ladle portion A at an angle of 116.565 degrees and being about 3.13 times the length of the fourth side of ladle portion A, a second side having a first end connected to a second end of the first side of handle portion B at an angle of about 96 degrees and being about six/sevenths the length of the first side of handle portion B, and a third side having a first end connected to a second end of the second side of handle portion B, said third side forming an angle of 26.565 degrees with an imaginary horizontal line and said third side of handle portion B being about the same length as the length of the first side of ladle portion A.

2. A tread and riser pan form according to claim 1 wherein the pan form is made from about 14 or 12 gauge sheet metal steel.

3. A tread and riser pan form according to claim 1 wherein the sides are of the following approximate lengths in inches.

| | |
|---|---|
| first side of ladle portion A | ½ |
| second side of ladle portion A | 1½ |
| third side of ladle portion A | 4.472 |
| fourth side of ladle portion A | 2.236 |
| first side of handle portion B | 7.0 |
| second side of handle portion B | 6 1/32 |
| third side of handle portion B | ½ |

4. A tread and riser pan form according to claim 1 wherein the pan form possesses a width of from about 36 inches up to about 72 inches.

5. A tread and riser pan form according to claim 1 in combination with means attached to same for varying the width of the step of the stairway to be built by using the pan form in the making of the step.

6. An assembly of a number of pan forms according to claim 1 to build a stairway of the number of steps desired by the user of the pan forms.

7. An assembly of a number of pan forms according to claim 6 wherein the pan forms become integrated into and a part of a concrete filled stairway to be built.

8. A universal tread and riser sheet metal pan form useful to cast precast concrete stairs, said pan form having a geometric cross-section shape similar to an inverted "S" with five sides, said sides including a first side having a length and forming an angle of 26.565 degrees with an imaginary horizontal line, said first side having a first end connected to a first end of a second side at an angle of 116.565 degrees, said second side being approximately two times the length of said first side, said second side having a second end connected to a first end of a third side at an approximate angle of 90 degrees, said third side being approximately twelve times the length of said first side, said third side being substantially horizontal, a fourth side having a first end connected to a second end of the third side at an angle of 116.565 degrees, said fourth side being approximately four times the length of said first side, and a fifth side having a first end connected to a second end of the fourth side at an approximate ninety degree angle, said fifth side forming an angle of 26.565 degrees with an imaginary horizontal line and said fifth side being approximately six times the length of said first side.

9. A tread and riser sheet metal pan form according to claim 8 and made of 12 gauge (0.1046") thick sheet metal steel.

10. A tread and riser sheet metal pan form according to claim 8 wherein the sides are of the following approximate lengths in inches:

| | |
|---|---|
| first side | 1 |
| second side | 2⅜ |
| third side | 12 |
| fourth side | 3⅝ |
| fifth side | 5.5–6 |

11. A tread and riser sheet metal pan form according to claim 8 wherein the pan form possesses a width of from about 36 inches up to about 72 inches.

12. A number of tread and riser sheet metal forms according to claim 8 coupled in series and clamped into desired rise and run proportion by means of attached clamping devices to vary height and length of a precast concrete stairway.

13. An assembly of a number of pan forms according to claim 8 to form a precast concrete stairway with the desired number of steps by the user of the pan forms.

14. An assembly of pan forms according to claim 8 wherein the pan forms are used for casting and building a precast concrete stairway but said pan forms do not become an integral part of the stairway.

15. A method of building a concrete-filled steel metal stairway which includes as an essential step in the construction of the stairway the utilization of a tread and riser pan form, having the features as set forth in claim 1.

16. A method of building a precast concrete stairway which includes as an essential step in the construction of the stairway the utilization of a tread and riser pan form, having the features as set forth in claim 8.

* * * * *